United States Patent [19]

Cluzel

[11] 4,094,528

[45] June 13, 1978

[54] SKI STRUCTURE

[76] Inventor: John Michael Cluzel, 753 Hickory Hill Rd., Wyckoff, N.J. 07481

[21] Appl. No.: 734,607

[22] Filed: Oct. 21, 1976

[51] Int. Cl.[2] ..... A63C 5/00

[52] U.S. Cl. ..... 280/610

[58] Field of Search ..... 280/610, 601, 602

[56] References Cited

U.S. PATENT DOCUMENTS 3,415,529 12/1968 Grill et al. ..... 280/610

FOREIGN PATENT DOCUMENTS 1,428,862 12/1968 Germany ..... 280/610

1,283,134 11/1968 Germany ..... 280/610

*Primary Examiner*—Joseph F. Peters, Jr.

*Assistant Examiner*—Gene A. Church

*Attorney, Agent, or Firm*—Donald P. Gillette

[57] ABSTRACT

A ski structure having a trapezoidal, foamed core wrapped with fiber-reinforced plastic with its wider base facing downward. The plastic sections covering the base and top of the trapezoidal core are rigidly joined to juxtaposed layers of fiber-reinforced plastic, which, in turn are combined with other layers of suitable material into a generally boxlike structure shaped like a ski. The spaces within the boxlike structure on each side of the trapezoid are also filled with foamed material.

6 Claims, 2 Drawing Figures

SKI STRUCTURE

BACKGROUND OF THE INVENTION

1. Field of the Invention

This invention relates to ski structures and particularly to a ski structure having greater torsional strength coupled with sufficient longitudinal flexibility to provide good directional control.

2. The Prior Art

Many forms of ski construction have been devised using what amounts to an external boxlike structure filled with a material different from the outer parts. A typical material used in the outer boxlike structure is fiberglass or, more broadly, fiber-reinforced plastic (FRP). Among the materials that have been used in the internal part of the ski structure have been layers of wood, spaced ribs with air between them, and expanded plastic material that is also referred to as foamed material. Some of the internal structures of skis have incorporated what is known as a torsion box extending longitudinally along the central part of the ski. The torsion box is intended to improve the twisting characteristics of the ski. In some cases the torsion box has been filled with foamed material, while in other cases it has simply been left open. Another internal structure in some skis has been referred to as an omega structure because it consists of ribs or plates joined together so that two of them rest on the bottom surface of the boxlike structure and two others extend at an angle toward a top rib that joins the angularly disposed ribs just under the top part of the boxlike structure. The angularly disposed members are supposed to absorb angularly directed forces such as are encountered in making sharp turns.

The disadvantage of ski structures of the type described in the preceding paragraph is that the torsion boxes as made heretofore have not been sufficiently resistent to laterally directed forces, and the omega structures have been subject to separation of the ribs from each other and from the top and bottom parts of the boxlike structure due to excessive lateral forces.

OBJECTS AND SUMMARY OF THE INVENTION

It is one of the objects of the present invention to provide an improved ski structure with a torsion box that has angularly disposed sides to provide greater resistance to lateral forces.

It is a further object of the present invention to provide a ski structure that has improved torsional qualities without sacrificing the longitudinal vertical flexibility needed for good control, especially in turns.

Other objects will become apparent from the following specification together with the drawings.

In accordance with the present invention, a central, trapezoidal core of foamed material with no mechanical directivity is wrapped, or enclosed, with fiber-reinforced plastic material. By virtue of the trapezoidal cross-section of the core, the resulting shape of the fiber-reinforced plastic case around it is also trapezoidal and has a relatively large base and a relatively small top as compared with the base joined together by two sloping sides. The top is adherently fixed to the underside of the top of an overall boxlike structure, and the bottom is also adherently affixed to the upper surface of the bottom member of the boxlike structure. The outer sides of the boxlike structure are formed of other members, and the spaces between these outer side members and the enclosed trapezoidal torsion structure are also filled with foamed material that has no mechanical directivity. Both the top and bottom members typically consist of several layers of suitable material and include corner reinforcements which, in accordance with standard ski construction, are usually of metal. The layers forming the top and bottom members preferably include FRP material for at least some of the layers.

DETAILED DESCRIPTION OF THE INVENTION

Figure 1:
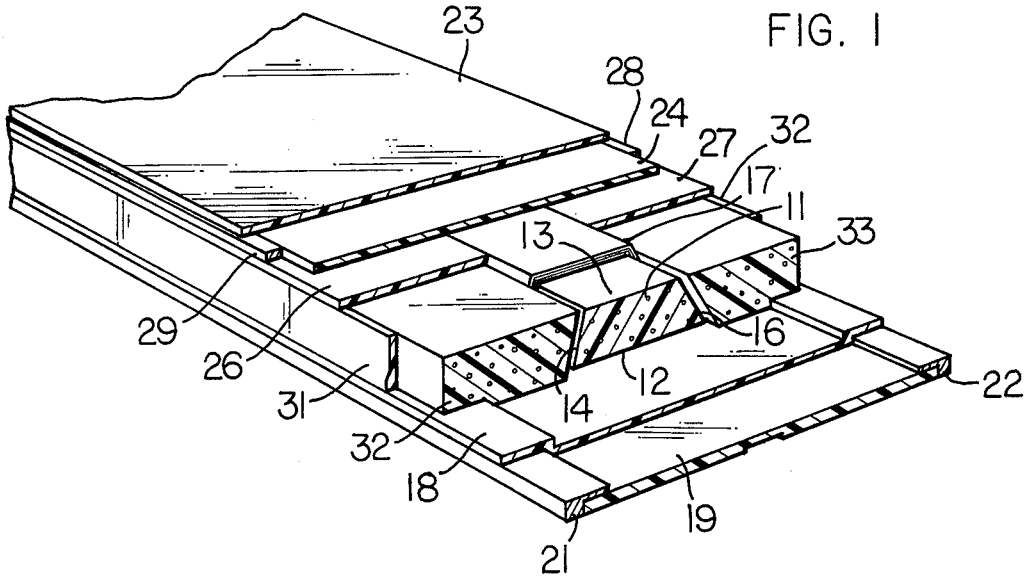
FIG. 1 is a perspective view of a section of a ski constructed according to the present invention and with parts of the structure cut away to show the internal structural features.

The ski structure in FIG. 1 includes a central trapezoidal member 11 of foamed plastic material such as expanded acrylic foam or expanded polyurathane or other suitable solid, foamed materials. The cross-sectional shape of this member is trapezoidal with a relatively large base 12 and a smaller top 13 joined by two inwardly directed edges 14 and 16. Wrapped around the member 11 is a fiber-reinforced plastic enclosure 17. The reinforcing fiber may be fiberglass, and the fibers can either be wrapped around the member 11 in a sort of helical wrapping, or the fibers can be formed in an interwoven double-helical structure similar to a well known device sometimes referred to as a Chinese finger lock. This type of fiber arrangement can be made in an elongated tube sufficiently loosely woven to allow it to be compressed so as to expand the cross-sectional dimensions thereof. After being pulled over the elongated member 11 that runs substantially the full length of the ski structure, the longitudinally compressed fiber sleeve can be pulled longitudinally to stretch it so that it fits snugly around the trapezoidal member 11. It is possible to make this as a prepreg material that is impregnated with plastic that can be cured to form a rigid box of trapezoidal cross-section fitting snugly around the core 11. Alternatively, a suitable plastic material may be coated onto the reinforcing fiber material and cured to harden it into the desired trapezoidal box structure.

The base of the box structure 17 is adherently affixed to a layer 18 of suitable material, such as a suitable FRP material. This layer in turn is firmly joined to a layer 19 of plastic material, especially a fluoro-carbon, such as a Teflon, or a polyethylene having good wearing qualities and being smooth and capable of being easily repaired if scratched. At the outer edges of the layer 19 are running edges 21 and 22, which are typically of a flexible steel alloy to provide the steering control desired in the ski structure. The layers 18 and 19 and the edges 21 and 22 may be considered to form, as a unit, the bottom member of a boxlike outer structure for a ski.

The ski shown in FIG. 1 also has a top member that consists of several layers firmly joined together. These include a topmost layer 23 that may be of plastic, alone, or may be reinforced with fibers. The purpose of this layer is primarily to provide a nicer looking ski structure, and thus the layer 23 may be considered to be a cosmetic layer. Under the layer 23 and inteimately joined to it is a layer 24 of FRP material, such as fiberglass. The lower surface of the layer 24 is adherently attached to the top surface of the box 17 to hold the box firmly in place. In order to assist in holding the box firmly in place, two additional side layers 26 and 27 of FRP material are firmly attached to side parts of the lower surface of the layer 24 and the edges of the layers 26 and 27 are also firmly attached to the upper parts of the sloping edges of the box structure 17. The last components in the upper member of the boxlike ski structure are two protective strips 28 and 29, typically of metal. Two sheets of solid material join the outer edges of the top and bottom members together. Only one of these sheets 31 is shown in FIG. 1. Phenolic material is suitable for the side member 31. It is required to be sufficiently flexible to permit the ski to be bent slightly in a direction perpendicular to the upper and lower members, and it must adhere well to the layers 18 and 26. A corresponding side member not shown in this drawing also joins the layer 18 to the layer 27. Additional formaed material 32 and 33 similar to the core 11 fills the remaining spaces.

Figure 2:
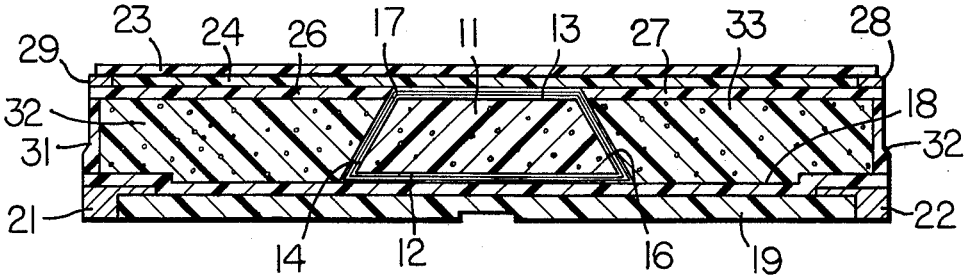
FIG. 2 is a cross-sectional view of the ski structure in FIG. 1.

FIG. 2 shows the same structure as in FIG. 1 and also shows the second side member 34. FIG. 2 also shows dimensions for a suitable ski structure. Numerical values for these dimensions are as follows:

$$50\text{mm} \leqq w \leqq 100\text{mm}: |b_b - b_t| \geqq 1.0\text{mm}$$
$$3\text{mm} \leqq t \leqq 30\text{mm}: 0.2 \leqq b_b/w \geqq 0.9$$

The dimension $t$ is the total thickness of the ski structure and varies from a relatively small value of about 3mm to a much larger value which may be as much as 30mm or so at the section of the ski where the boot clamps are located. The dimensions $b_b$ and $b_t$ are the base and top widths of the trapezoidal torsion box, and the dimension on $w$ is the overall width of the ski.

With a ski constructed as described hereinabove, the desirable flexibility in the vertical direction is retained to pemit the ski to follow sharp curves in the track as are encountered in high speed runs. At the same time the trapezoidal torsion box structure absorbs loads that include a lateral component. These loads are also encountered especially in turns, and by their proper absorption, they prevent the ski from twisting. This has the advantage of keeping the ski under better control and at the same time not subjecting the layers to disruptive forces to as great a degree as it true in the absence of the trapezoidal torsion box constructed according to this invention.

While this invention has been described in terms of a specific embodiment, it will be understod by those skilled in the art that modifications may be made therein without departing from the true scope of the invention as defined by the following claims.

What is claimed is:

1. A ski structure comprising:

a central member of solid foamed material free of mechanical directivity and extending longitudinally along the structure and having a trapezoidal cross-section defined by a base, a top narrower than the base and substantially parallel to the base, and two sides joining the edges of the base to the corresponding edges of the top;

a trapezoidal torsion box of fiber-reinforced plastic fitting snugly around the central member and comprising a base and a top corresponding in width to the base and top, respectively, of the central member;

a solid, resilient bottom member wider than the base of the trapezoidal torsion box, the box being firmly adherently joined to the upper surface of the bottom member to remain in fixed position relative the the bottom member in spite of forces having lateral components acting on the trapezoidal torsion box and the bottom member, the bottom member being much wider than it is thick;

a solid, resilient top member wider than it is thick over at least most of its length, and rigidly, adherently joined to the top of the trapezoidal torsion box to remain in fixed position relative to the top member in spite of said forces acting to move the top member relative to the trapezoidal torsion box, the top member being wider than the top of the trapezoidal torsion box;

a pair of solid, resilient side members joining edge sections of the top member to corresponding edge sections of the bottom member to form an outer boxlike structure; and solid, foamed material free of mechanical directivity at least substantially filling the spaces on each side of the trapezoidal torsion box and within the outer boxlike structure.

2. The ski structure of claim 1 in which the fiber reinforced plastic comprises plastic reinforced by glass fiber wound generally helically around the central member.

3. The ski structure of claim 1 in which the trapezoidal torsion box is substantially centrally located between the side members of the outer boxlike structure.

4. The ski structure of claim 3 in which the side of the trapezoidal torsion box facing the inside of a turn executed by a skier wearing the ski structure is more nearly vertical than the outer side of the trapezoidal torsion box.

5. The ski structure of claim 1 in which the bottom member comprises:

a bottom layer of smooth, repairable plastic;

a pair of outer metal edges rigidly joined to the bottom layer; and an upper layer of fiber-reinforced plastic fixedly joined surface-to-surface with the bottom layer.

6. The ski structure of claim 1 in which the top member comprises:

an uppermost layer of plastic substantially as wide as the outer boxlike structure;

a central layer of fiber-reinforced plastic of slightly lesser width than the uppermost layer;

a pair of outer protective edge members outside of the central layer; and a pair of locating layers of fiber-reinforced plastic abutting opposite edges of the top of the trapezoidal torsion box, the pair of locating layers, the central layer, the protective edge members, and the uppermost layer being adherently joined together to form the top member as a solid resilient member several times as wide as it is thick.

* * * * *